US006622734B1

(12) United States Patent
Bielinski et al.

(10) Patent No.: US 6,622,734 B1
(45) Date of Patent: Sep. 23, 2003

(54) HAIR STYLING DEVICE

(76) Inventors: Richard D. J. Bielinski, 7349 E. Avenida Perlina, Tucson, AZ (US) 85746; Michele M. Morris, 7711 N. Camino de Maximillian, Tucson, AZ (US) 85704

( * ) Notice: Subject to any disclaimer, the term of this patent is extended or adjusted under 35 U.S.C. 154(b) by 0 days.

(21) Appl. No.: 09/863,686

(22) Filed: May 23, 2001

(51) Int. Cl.[7] ..... A45D 1/100; A45D 2/40; A45D 2/24; A45D 8/20

(52) U.S. Cl. ..... 132/224; 132/225; 132/260; 132/277

(58) Field of Search ..... 132/224, 225, 132/263, 260, 259, 276, 277, 278, 273

(56) References Cited

U.S. PATENT DOCUMENTS 257,784 A * 5/1882 Swartz ..... 132/224
273,957 A * 3/1883 Clother ..... 132/224
570,413 A * 10/1896 Thompson ..... 132/224
1,380,064 A * 5/1921 Hoffman ..... 132/224
1,558,913 A * 10/1925 Parshall ..... 132/224
1,570,141 A * 1/1926 Glantz ..... 132/224
1,682,455 A * 8/1928 Wilson ..... 132/224
4,261,375 A * 4/1981 Anderson ..... 132/224
4,508,124 A * 4/1985 Franzino ..... 132/224
4,739,776 A * 4/1988 Prijic ..... 132/224
6,142,159 A * 11/2000 Lloyd ..... 132/278
6,223,753 B1 * 5/2001 Lo ..... 132/224

* cited by examiner

*Primary Examiner*—John J. Wilson
*Assistant Examiner*—Robyn Kieu Doan

(57) ABSTRACT

A simple hair styling device is described which allows a person to style and dry his or her hair to be easily either naturally or with a hair dryer. Opposing sides of the device capture the hair and maintain the hair in a set shape while the hair dries. The hairstyle produced by the device is controlled by the preselectable contour of the opposing sides of the device. The device is easy to grasp and open and is intended for single-handed operation. The device can aid a person having impaired use of his or her hands and arms to style his or her own hair.

3 Claims, 2 Drawing Sheets

HAIR STYLING DEVICE

TECHNICAL FIELD

The present invention relates to hair care and more particularly to a new and improved device for styling and shaping a person's hair.

BACKGROUND OF THE INVENTION

For centuries men and women have endeavored to style their hair in many different fashions and many devices to aid such styling have been available. Recent examples of such devices include barrettes or clips which are worn in the hair to establish and maintain a hair style (See: U.S. Pat. No. 5,477,870 (1995), U.S. Pat. No. 5,816,267 (1998), and U.S. Pat. No. 6,142,159 (2000)).

Another approach to the styling of hair has been to form and lock the hair into a preselected style while it is wet and thereafter to remove the locking devices utilized in the styling process when the hair has dried. A similar approach is used when a chemical substance is used to achieve a more lasting curl or wave in hair which naturally has no curl, i.e. the so-called "permanent wave". For years, the primary option for setting hair to form waves or curls has been to form or roll the hair around cylindrical forms or "curlers". The use of curlers limits the flexibility of styles, can be very time consuming, can make hair difficult to dry, and usually involves a multiplicity of such devices to hold all of a person's hair in place while it is in the process of drying and setting. When hair is wrapped around devices which are cylindrical in shape, the hair tends to fall in a spiral when the device is removed which may or may not be the desired effect. Further, hair styled in this manner tends to have a fluffy look when the devices are removed. Recent attempts to address the problem of holding the hair while it is being styled are disclosed in U.S. Pat. No. 5,411,040 (1995), U.S. Pat. No. 5,829,455 (1998), and U.S. Pat. No. 6,041,791 (2000). These devices provide a means for holding a plurality of strands in a roll during the process of styling the hair. The hairstyle which these devices produce is very similar to that which is produced using cylindrical forms or curlers. None of these devices provide a simple means for achieving flexibility in the hairstyle produced.

Further, in recent years the high cost of personal services has made the public more aware of the need to provide devices which can enable persons to effectively style their own hair, preferably without assistance. Another desiratum is to provide a device which can be readily used by a person lacking flexibility in his or her hands because of diseases such as arthritis or like muscular diseases so that they can readily place the multiple curlers into their hair to achieve the desired styling of that hair. Likewise, most hair styling devices available today are nearly impossible to use by a person who has an impairment in the use of his or her hands or arms due to accident.

Thus, as will appear, the present invention fulfills a long time need for a simple device to enable an individual to style their own hair regardless of condition of the hair. Further, the present invention is useable by a person having a disability which otherwise limits his or her ability to fully use both hands and arms in the styling of their hair.

BRIEF SUMMARY OF THE INVENTION

The invention is a device which can be used to produce a wide range of hairstyles very simply, and using a limited amount of styling equipment. The invention provides for maximum circulation of air during natural drying of the hair or while using a hair dryer to dry the hair.

The device is an easy to use styling form for the hair which creates a multiple of curls or waves at the same time. Further, the device is complete in itself and does not require additional pins or clips to hold the hair in place. The device can be held and inserted into a person's hair using only one hand.

The device consists of two hinged sides opposing one another with the hair to be styled disposed between the opposing sides when the device is closed. Wet hair to be styled is placed between the opposing sides when the device is in an open position. The sides are then rotated to a closed position and maintained in the closed position until the hair has dried. The device is then opened and removed from the newly styled hair. The form of the opposing sides of the device controls the hairstyle achieved. The device creates a plurality of curls in the hair with a single insertion, thereby greatly reducing the time required for styling the hair.

The device facilitates the effective, fast, convenient, self contained, and versatile styling of a person's hair. Accordingly, it is a primary object of the invention to provide a simple device for styling a person's hair which is not limited to a single style. It is a further object of the invention to provide a device which can be used by a person having a limitation in the dexterity of his or her hands and arms to style their own hair.

These and further objects, as shall hereafter appear, are readily fulfilled by the present invention in a remarkably unexpected manner as will be readily discerned from the following detailed description of an exemplary embodiment thereof especially when read in conjunction with the accompanying drawings in which like parts bear like numerals throughout.

BRIEF DESCRIPTION OF THE DRAWINGS

In the drawings:

FIG. 2(*b*) is a vertical elevation of the device of FIG. 2(*a*) in its closed position;

FIG. 2(*c*) is a cross-section taken on line c—c of FIG. 2(*b*);

DESCRIPTION OF THE PREFERRED EMBODIMENT

A brief description of an exemplary embodiment of the present invention is set forth herein in sufficient detail to allow a person skilled in the art to understand the operation and fully utilize the invention. The numbered parts of the description refer to the parts identified in the attached figures in which like parts bear like numerals throughout the invention.

Figure 1:
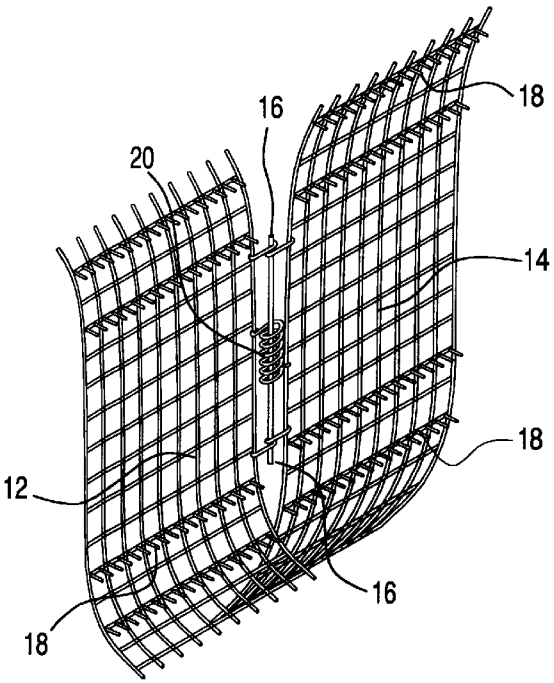
FIG. 1 is an isometric view of one embodiment of the present invention wherein the opposing sides of the invention are curved planes.

Referring to FIG. 1, in the simplest form the device 10 comprises a pair of opposing sides 12, 14 connected to each other by a suitable hinge 16. The opposing sides 12, 14 can be formed with planar surfaces which can be curved in one direction to form a person's hair (not shown in this figure) into waves. In one embodiment, the opposing sides 12, 14 can be formed of an open mesh material as shown in FIG. 1 or a material having a plurality of holes passing therethrough to allow for the circulation of air to dry the hair. The embodiment shown in FIG. 1 produces a soft wave without a fluffy look. In the event that a person wants to reduce the curliness of otherwise naturally curly hair, the opposing sides 12, 14 can be formed with planar surfaces, that is, without any curvature. Hinge 16 provides for opposing sides 12, 14 to rotate toward each other in a "closed" position and away from one another from the closed position to an open position as shown in FIG. 1. The hair to be styled is inserted between the opposing sides 12, 14 while sides 12, 14 are in an open or partially open position. A plurality of teeth 18 disposed in rows protrude from opposing sides 12, 14 and hold the hair in place when the device is closed about the hair. Once the hair is in place, opposing sides 12, 14 are rotated toward one another until the hair is disposed between opposing sides 12, 14. This is the closed position of the device. A spring 20 operating about the centerline of hinge 16 provides the force to maintain opposing sides 12, 14 in a closed position with the hair held in place. Depending upon the hairstyle sought to be achieved, opposing sides 12, 14 can take a variety of forms. Opposing sides 12, 14 can even be formed of a bendable material so that a variety of hairstyles can be achieved with a single device.

Figure 2A:
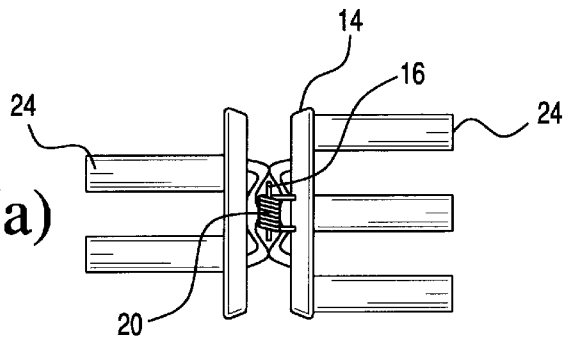
FIG. 2(*a*) is a vertical elevation of another device embodying the present invention in which the opposing sides of the device comprise complementary prongs, each of which has a cylinder disposed thereupon and showing the device in a fully open position.
Figure 2B:
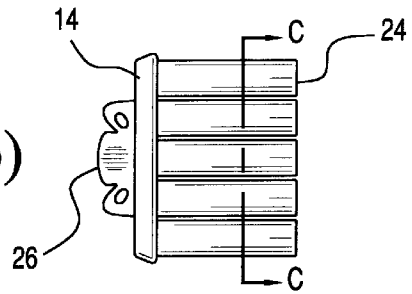
Figure 2C:
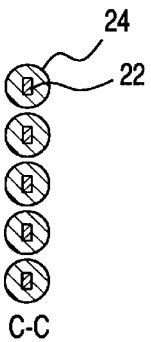
Figure 3:
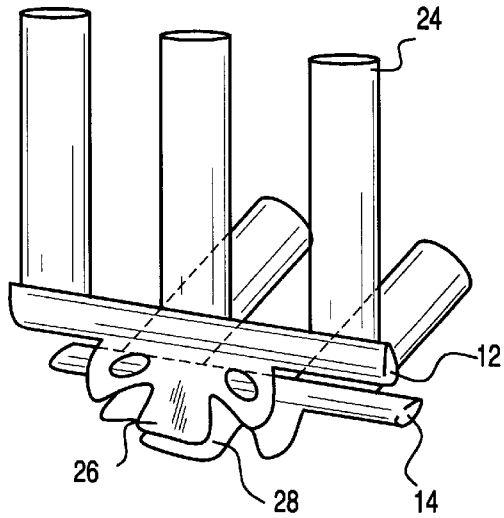
FIG. 3 is an isometric view of the device of FIG. 2 wherein the opposing sides of the invention include prongs and removable cylindrical forms and the device is in a partially open position.

Referring to FIGS. 2(*a*), (*b*) and (*c*), an alternative embodiment of the device is shown in which opposing sides 12, 14 have multiple prongs 22 upon which cylindrical forms 24 can be attached to or molded as a part thereof. The prongs 22 and cylindrical forms 24 of the opposing sides 12, 14 are disposed in an offset position so that each prong 22 and cylindrical form 24 is interleaved with the other prong-cylinder combinations when the device is in the closed position. (See FIG. 2(*b*)). The hair to be styled is inserted between opposing sides 12, 14 while in the open position as shown in FIG. 2(*a*) or in a partially open position as shown in FIG. 3. When the opposing sides 12, 14 are rotated to the closed position, the hair is held in a serpentine path between the complementary cylindrical forms 24 of opposing sides 12, 14. The size of the curls produced by the device can be varied by changing the diameter of cylindrical forms 24 and the spacing of prongs 22.

Figure 4:
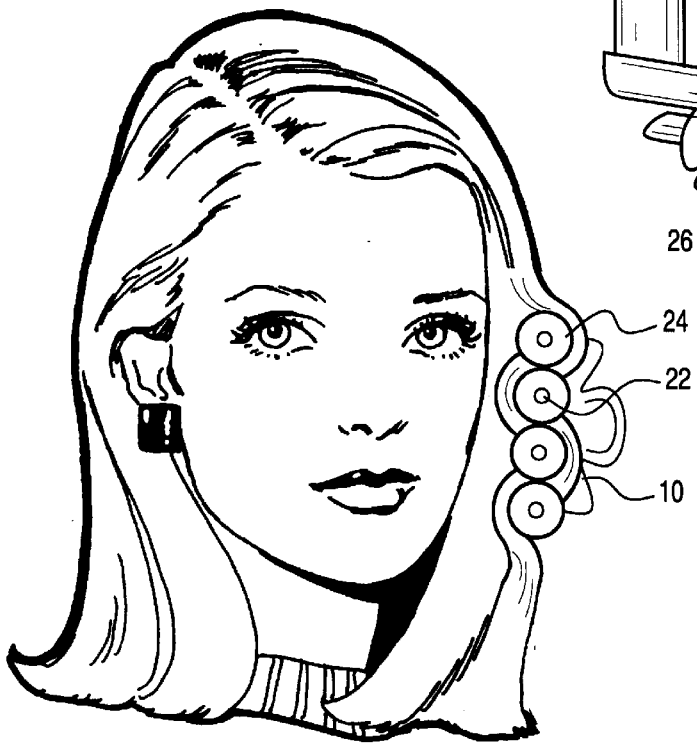
FIG. 4 shows the device of FIGS. 2 and 3 when in its closed position while disposed in a person's hair.

Referring to FIG. 2(*b*) and FIG. 3, each of the opposing sides 12, 14 are provided with tab portions 26 and 28 for rotating opposing sides 12, 14 to an open position. The centerline of the hinge 20 provides the axis of rotation. For each of the opposing sides 12, 14, the portion which holds the hair is on one side of the axis of rotation and tab portions 26 and 28 are on the other. To open the device, pressure is applied between the tab portions 26 and 28 of opposing sides 12, 14 to counter the force of spring 20 as it holds the device in its closed position. FIG. 3 shows the device of FIG. 2 in a partially open position. Releasing the pressure on tab portions 26 and 28 allows the device to return to its closed position in response to spring 20. Referring to FIG. 4, device 10 is shown in a closed position with a person's hair disposed in the device and ready for drying and styling.

Figure 5:
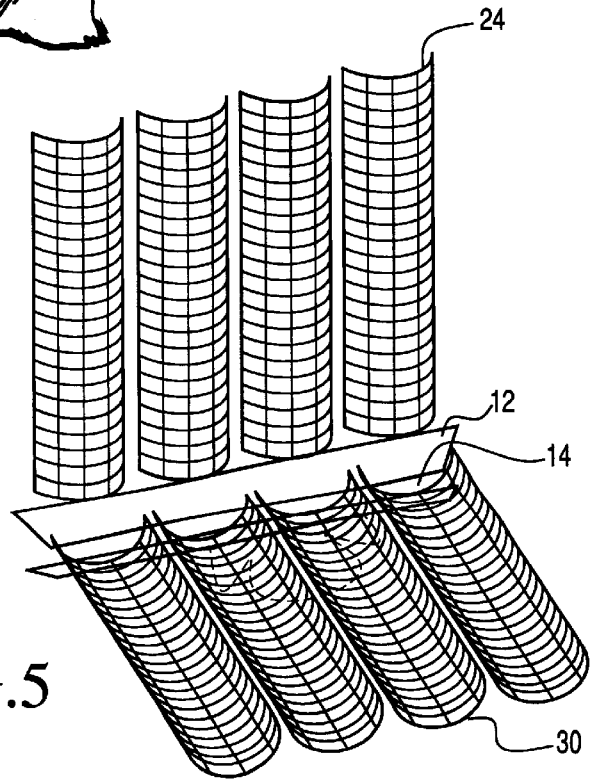
FIG. 5 is an isometric view of a device embodying the present invention in which a first opposing side of the device comprises prongs, each having a cylinder disposed thereupon and a second opposing side of the device comprises connected complementary half cylinders disposed thereupon and the device is in a partially open position.

Referring to FIG. 5, an alternative embodiment of the device is shown in which the opposing side 14 comprises a plurality of connected half cylinders 30 complementary to the cylindrical forms 24 of opposing side 12.

Pressure on tab portions 26 and 28 is normally supplied by the thumb and forefinger of the person doing the styling. By altering the shape of tab portions 26 and 28 of opposing sides 12, 14, the device can be made to facilitate its use by the palm and multiple fingers of a person having less strength due to disability.

The device can be manufactured from a number of materials including both metal and plastic. By choosing the proper plastic, the spring of the device can simply be a section of reduced cross-section connecting the two opposing sides. In this way, the device can be formed as one piece to make it more economical to produce.

In addition to forming the prong sections of the device into various shapes, a number of different styling devices can be affixed to the prongs or the base of the clip. One approach involves placing a curler around each prong, the diameter of the curlers being chosen so that there is a small space between adjacent curlers to accommodate the hair being styled when the device is in its closed position. The curlers may be made of plastic, wire, or foam rubber as is already well known. The length of the device can be extended or shortened to vary the number of curls produced by a single insertion of the device in the hair.

To style hair using this device, the device is first opened which by pressing on tab portions 26, 28 exposes a row of curlers on each side of the now open device. The rows of curlers are then placed over and under a selected section of hair. When the desired section of hair is loaded, the pressure on tabs 26, 28 is released and the opposing sides close to hold the hair therebetween where it is dried and automatically formed into the desired wave pattern formed by the interaction of the intermeshed curlers with the hair. The device can be made in different dimensions and with different sized curlers to create the desired wave effect in different types of hair. If the hair is longer than the device is wide, additional devices can simply be added below the first.

While the hair is in the device in the closed position, it can be left to air dry or be dried with a conventional hair dryer. Using any of the described forms of the device, the hair will dry much more quickly than traditional methods since the hair is distributed more uniformly within the device instead of being wound tight to the scalp. Further, the device provides for maximum circulation of air. During the drying process, the device can be lifted away from the person's head to aid in drying the hair on the side of the device closest to the scalp.

From the foregoing, it is readily apparent that a new and useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A hair styling device for drying and styling natural hair, said device comprising a first side member and a second side member, each of said side members being formed of a semi-rigid material and including means to trap and hold natural hair therebetween and including means to enable the flow of air therethrough; hinge means operatively disposed between said first side member and said second side member to permit said first and second side members to rotate relative to each other in an open and a closed position; biasing means for maintaining said first and said second side members in a closed position, and means for overcoming said biasing means and moving said first and said second side members into an open position; each of said side members is formed with a plurality undulations in such a manner that the undulations of said first side member complement the undulations of said second side member when said side members are in a closed position.

2. The hair styling device of claim 1 in which said side members are planar surfaces.

3. The hair styling device of claim 1 in which said side members are formed of a material which can be bent into a preselected shape which shape will be retained until said side members are bent a second and succeeding times.

* * * * *